US006151871A

United States Patent [19]

Torre

[11] Patent Number: 6,151,871

[45] Date of Patent: Nov. 28, 2000

[54] MACHINE FOR PACKAGING ARTICLES WITH HEAT-SHRINKABLE FILM

[75] Inventor: Francesco Torre, Dalmine, Italy

[73] Assignee: Minipack-Torre S.p.A., Italy

[21] Appl. No.: 09/319,065

[22] PCT Filed: Nov. 28, 1997

[86] PCT No.: PCT/EP97/06946

§ 371 Date: May 28, 1999

§ 102(e) Date: May 28, 1999

[87] PCT Pub. No.: WO98/24693

PCT Pub. Date: Jun. 11, 1998

[30] Foreign Application Priority Data

Dec. 3, 1996 [IT] Italy ..... MI96U0787

[51] Int. Cl.[7] ..... B65B 53/02

[52] U.S. Cl. ..... 53/557

[58] Field of Search ..... 53/557, 442

[56] References Cited

U.S. PATENT DOCUMENTS 3,357,153 12/1967 Shaffer ..... 53/557

4,667,456 5/1987 Raffault ..... 53/557

FOREIGN PATENT DOCUMENTS 2342894 9/1977 France .

2397329 2/1979 France .

*Primary Examiner*—Linda Johnson

*Attorney, Agent, or Firm*—Shlesinger, Fitzsimmons & Shlesinger

[57] ABSTRACT

A machine for packaging products (11) with film (12) made of heat shrinkable material, comprises a body (13) containing a lower portion (14) of a shrinkage chamber which houses, wrapped in film (12), a product (11) to be packaged, and a cover (16), hinged to said body (13) and defining an upper portion (17) of the shrinkage chamber. Disposed in the shrinkage chamber (14, 17) are a heating unit (22) and a ventilating unit (26, 27) to create air circulation (29, 30, 31) inside said chamber. The ventilating unit (26, 27) is situated above the heating unit (22) to generate, when in operation, at least a flow of air (31) through the heating unit (22) in the direction of the bottom of the shrinkage chamber (14, 17).

10 Claims, 2 Drawing Sheets

MACHINE FOR PACKAGING ARTICLES WITH HEAT-SHRINKABLE FILM

This invention refers to a machine for packaging products with film made of heat-shrinkable material. According to this technique, the product to be packaged is wrapped in a film of heat-shrinkable material and placed inside a packaging machine, where the film is sealed and heat-shrunk to enclose the product. The heat required to thermally treat the film is generated by electric heating units disposed in a suitable position inside the compartment receiving the product. An example of these machines is shown in FR-A-2,397,329.

There are known packaging machines in which special fans are disposed on the bottom of the compartment (see FR-A-2,342,894) below the heating unit and the surface supporting the product to be packaged, to create a circulation of air in the compartment in order to distribute the heat over the entire surface of the film.

Despite endeavours made to improve the circulation of the hot air in the compartment, the positioning of the fans according to the known technique does not allow the air to flow evenly enough over the entire surface of the film wrapped around the product. In particular, the lower part of the compartment tends to remain colder than the upper part, due to the tendency of the heat produced by the heating element to migrate upwards by convection. This can result in packaging of an unsatisfactory quality. Unevenness in the distribution of the heat also means that, in order to reach, in the lower part of the compartment, at least the minimum temperature required to shrink the film, the temperature in the upper part is considerably higher, resulting in an evident waste of energy.

A further drawback of the known machines is that, when the operator opens the cover to remove the packaged product, he is inundated by a large quantity of hot air escaping from the compartment. Moreover, since the fan is located in the lower part of the compartment, where dust and other particles of dirt easily accumulate, it inevitably whips up said dust which ends up by blowing onto the operator when he opens the cover. For example, parts of the product to be packaged may fall to the bottom of the compartment and be crushed by the rotating fan and be hurled dangerously at the operator.

The general scope of this invention is to obviate the aforementioned problems by providing a packaging machine in which the heat-shrinkable film wrapped around the product to be packaged is evenly bathed by the hot air circulating inside the compartment, thereby saving a considerable quantity of energy.

A further scope of the invention is to provide a machine in which there is no considerable emission of hot air when the compartment is opened.

These scopes are achieved according to the invention by providing a machine for packaging products with film made of heat shrinkale material.

The innovative principles of this invention and its advantages with respect to the known technique will be more clearly evident from the following description of a possible exemplificative embodiment applying such principles, with reference to the accompanying drawings, in which.

Figure 1:
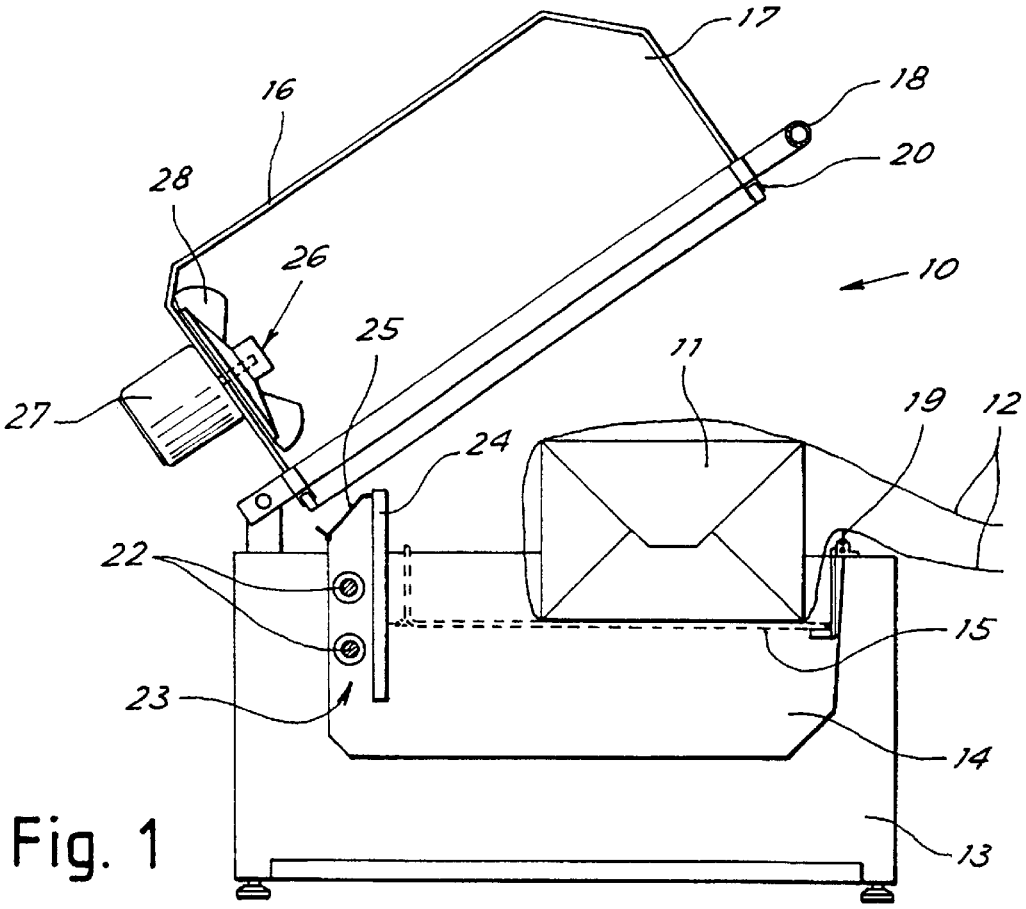
FIG. 1 shows a cutaway side view of a packaging machine according to the invention.

With reference to FIG. 1, a machine for packaging products 11 by means of film 12 made of heat-shrinkable material is generically indicated by reference 10.

The machine comprises a body 13 containing a lower portion 14 of a shrinkage chamber which houses, inserted between two layers of the film 12, a packet 11 to be packaged. Disposed in this portion of the chamber is a perforated support 15, advantageously a grille to support the packet 11 while at the same time allowing the air to flow towards the surface of the film covering the lower face of the packet.

Hinged onto the body 13 is a cover 16, which defines an upper portion 17 of the shrinkage chamber. The cover 16 is provided with a handle 18 to enable it to be opened and closed by an operator.

Figure 2:
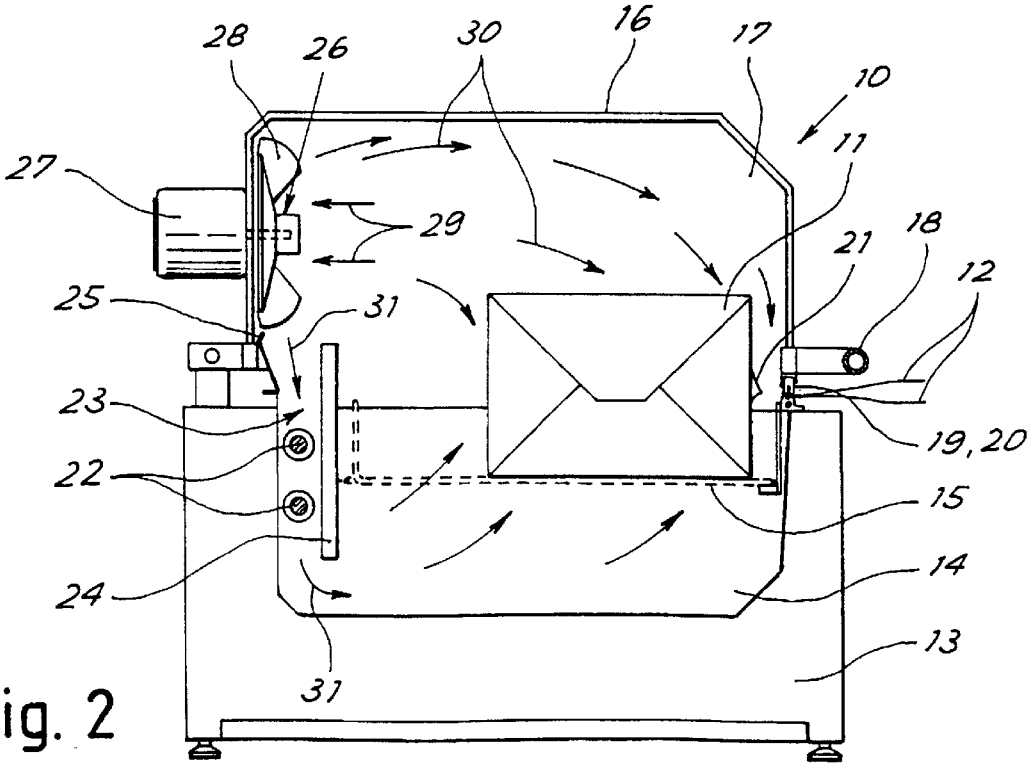
FIG. 2 shows a view similar to that of FIG. 1, but in the operating condition, with the cover closed.

Body 13 and cover 16 are also provided with respective opposing sealing elements (for example a blade 19 and a corresponding contrast 20), which are brought into contact with each other when the cover is closed to obtain a thermal seal 21 of the two layers of film 12, as can be clearly seen in FIG. 2.

Disposed in the lower portion 14 of the shrinkage chamber, advantageously in correspondence with its rear portion, is a heating unit 22 consisting of electric elements controlled by a thermostat.

As can be seen in FIGS. 1 and 2, the heating elements 22 are contained in a rear chamber 23, separated by means of a partition wall 24 from the rest of the portion 14 of the compartment housing the product to be packaged so as to communicate with it only from below.

The rear chamber 23 is also separated from the upper portion 17 of the shrinkage chamber by means of an openable door 25, hinged to the body of the machine. Suitable cam-operating means, not shown in the figure in that they are well known to the expert in the field, are disposed on the cover 16 to control the closing and opening of the door 25 when the cover is raised and lowered, respectively. The two positions are shown respectively in FIG. 1 and in FIG. 2.

According to the innovative principles of this invention, a fan 26, operated by a motor 27, is disposed above the heating elements 22 to create a circulation of air inside the shrinkage chamber. The ventilating unit 26 is controlled in a known way by a microswitch to automatically come into operation when the cover 16 is closed and to stop when it is opened.

A brief description will be given below of the operation of the packaging machine according to the invention. Once the product 11 to be packaged, wrapped in the film 12, has been placed on the support 15 of the shrinkage chamber 14, 17, the cover 16 is lowered, by operating the sealing elements 19, 20 and automatically controlling the opening of the door 25 and the starting up of the fan 26. The fan has vanes 28 shaped in such a way as to create an axial flow of air suctioned from the inside of the shrinkage chamber, schematized in FIG. 2 by means of the arrows 29. The air suctioned axially by the fan is transmitted by centrifugal action towards the upper portion 17 of the shrinkage chamber (arrows 30), and towards the chamber 23 which contains the heating unit 22 (arrows 31).

The airflow 31 is heated by flowing across the heating elements 22, thereby enabling the hot air to also reach the lower portion 14 of the shrinkage chamber. In the packaging machine according to the invention, the hot air is consequently distributed in a substantially uniform manner over the entire surface of the film 12, resulting in an optimal packaging and saving a considerable amount of energy both in generating the heat and in creating the airflow.

Its greater efficiency with respect to the known machines also makes it possible to reduce or eliminate the thermal insulation on the lower part of the shrinkage chamber. In particular, the latter can be made with a perfectly smooth bottom which can therefore be easily cleaned of any deposits of products to be packaged.

Once the packet 11 has been packaged, the cover 16 is raised, thereby causing the fan 26 to stop and the door 25 of the heating chamber 23 to close.

It should be noted that when the door 25 is closed it prevents the heat generated by the heating elements 22 from passing into the upper portion 17 of the compartment housing the packet and from there escaping to the outside, where the operator is working. Moreover, the residual inertial rotation of the fan in the instants following the opening of the cover creates a slight suction of the hot air in the upper portion of the compartment, helping to prevent it from escaping to the outside.

The disposition of the fan in correspondence with the upper portion of the shrinkage chamber makes it possible to achieve considerable structural simplification of the body of the machine.

Moreover, the position of the fan prevents the particles of dirt deposited on the bottom of the shrinkage chamber from being whipped up, thereby preventing the operator from being showered with them upon opening the cover.

In the embodiment shown in FIGS. 1 and 2, the motor-fan unit 26, 27 is fitted on the lid 16, in correspondence with its rear wall. The entire unit is consequently movable together with the cover.

Figure 3:
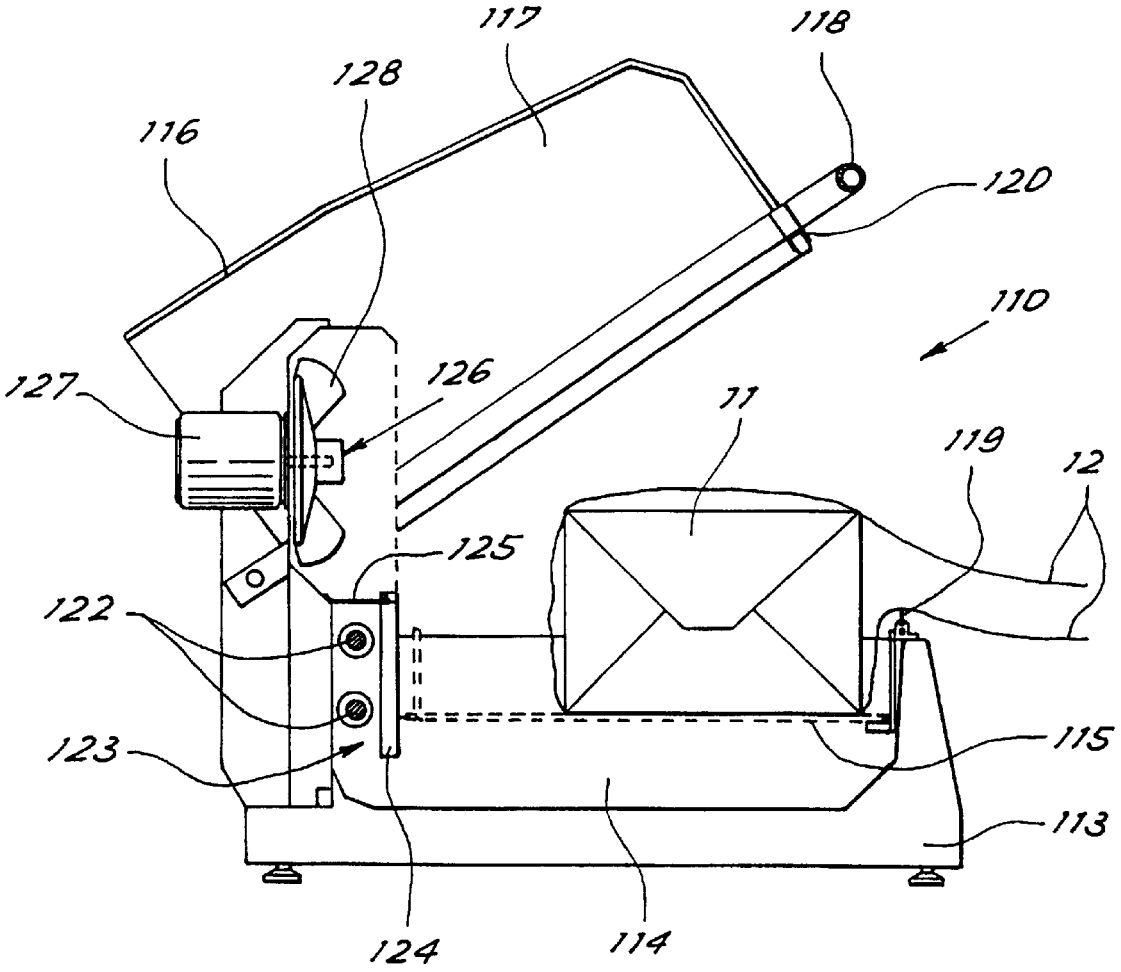
FIG. 3 shows a view similar to that of FIG. 1, referring to a different embodiment of the machine according to the invention.

The fan and the motor can also be made integral with the body of the machine, as shown in the variation of the embodiment of FIG. 3, where for convenience the corresponding elements or elements similar to those of the previous embodiment are indicated with the same numbering, increased by 100. In this case, in correspondence with its rear part, the cover 116 can be either completely or partially open, so as to avoid interference with the motor 127 and the fan 126. It is obvious that, depending upon the structural variation chosen, the machine must be provided with the most appropriate structural devices, obvious to the expert in the field, to ensure the correct support of the motor-fan unit.

The foregoing description of an embodiment applying the innovative principles of this invention is obviously given by way of example in order to illustrate such innovative principles and should not therefore be understood as a limitation to the sphere of the invention claimed herein. For example, the ventilating unit 26, 126 can be composed of several fans, each operated by its respective motor 27, 127. Moreover, the fans can be equipped with vanes having a different configuration, provided that they are capable of creating inside the shrinkage chamber a circulation of air qualitatively similar to that shown in FIG. 2. For example, radial fans can be used, or centrifugal fans with forward inclined vanes, etc.

I claim:

1. A machine for packaging products (11) with film (12) made of heat shrinkable material, comprising a body (13, 113) and a cover (16, 116) hinged to said body to define a shrinkage chamber between them, said chamber housing, wrapped in film (12), a product (11) to be packaged and being provided with a supporting element (15, 115) for the film-wrapped product (11), said body and said cover defining, restectively, a lower portion (14, 114) and an upper portion (17, 117) of the shrinkage chamber, at least an air passage (23, 123) being provided between said upper and lower portions of the shrinkage chamber, the packaging machine further comprising a heating unit (22, 122) and a ventilating unit (26, 27, 126, 127) arranged in said shrinkage chamber to create hot air circulation (29, 30, 31) surrounding the product (11) to be packaged, with air paths (31) connecting the upper portion (17, 117) to the lower portion (14, 114) of the shrinkage chamber along said air passage (23, 123) the ventilating unit (26, 27, 126, 127) being disposed in the upper portion (17, 117) of the shrinkage chamber and above the heating unit (22,122), and the heating unit being disposed between the ventilating unit (26, 27, 126, 127) and the bottom of the shrinkage chamber and within a rear heating chamber (23, 123) forming said air passage (23, 123), the rear heating chamber (23, 123) being separated from the supporting element (15, 115) and the product to be packaged by means of a wall (24, 124).

2. Packaging machine as claimed in claim 1, characterized in that the heating chamber (23, 123) communicates from below with the lower portion (14, 114) of the shrinkage chamber and from above, through an aperture closable by means of a door (25, 125), with the upper portion (17, 117) of the shrinkage chamber.

3. Packaging machine as claimed in claim 1, characterized in that the ventilating unit (26, 27, 126, 127) is disposed in correspondence with the upper portion (17, 117) of the shrinkage chamber.

4. Packaging machine as claimed in claim 1, characterized in that the ventilating unit is composed of at least one fan (26, 126) operated by a corresponding motor (27, 127) and provided with vanes (28, 128) capable of generating within the shrinkage chamber (14, 17, 114, 117), upon closure of the cover (16, 116), circulation of air consisting of a substantially axial suction flow (29) and substantially radial flows (30, 31) directed respectively towards the upper portion (17, 117) of the shrinkage chamber and towards the lower portion (14, 114) of said chamber, passing through the heating chamber (23, 123).

5. Packaging machine as claimed in claim 1, characterized in that the operation of the ventilating unit (26, 27, 126, 127) is controlled by the closed position of the cover (16, 116).

6. Packaging machine as claimed in claim 2, characterized in that the door (25, 125) is made to open by closing the cover (16, 116) and to close by opening said cover.

7. Packaging machine as claimed in claim 1, characterized in that the heating unit (22, 122) is composed of electric heating elements controlled by a thermostat.

8. Packaging machine as claimed in claim 3, characterized in that the ventilating unit (26, 27) is integral with the cover (16), and fitted in correspondence with a rear wall of the latter.

9. Packaging machine as claimed in claim 3, characterized in that the ventilating unit (126, 127) is integral with the body (113) of the machine, the cover (116) being open in correspondence with its rear wall for its free movement with respect to the ventilating unit.

10. Packaging machine as claimed in claim 1, characterized in that, disposed in the lower portion (14, 114) of the shrinkage chamber is a perforated support (15, 115) to support the product (11) to be packaged, allowing the passage of air towards the surface of film (12) covering the product in correspondence with said support (15, 115).

* * * * *